US006631803B2

(12) United States Patent
Rhodes et al.

(10) Patent No.: US 6,631,803 B2
(45) Date of Patent: Oct. 14, 2003

(54) BEVERAGE COOLER BOX

(75) Inventors: Terrance E. Rhodes, Erie, CO (US); Brett Lee Schuetz, Thornton, CO (US); Michael Christopher Cruz, Denver, CO (US); Patricia O. Shibata, Denver, CO (US); Lee Buxton, Longmont, CO (US); Patrick B. Edson, Lakewood, CO (US); Raymond Scott Kastanek, Longmont, CO (US); Gary Lawrence Gresge, Arvada, CO (US); Stephen Mark Kaczmarek, Golden, CO (US)

(73) Assignees: Coors Brewing Company, Golden, CO (US); Graphic Packaging Corporation, Golden, CO (US)

( * ) Notice: Subject to any disclaimer, the term of this patent is extended or adjusted under 35 U.S.C. 154(b) by 53 days.

(21) Appl. No.: 09/815,102

(22) Filed: Mar. 21, 2001

(65) Prior Publication Data

US 2002/0134698 A1 Sep. 26, 2002

(51) Int. Cl.[7] ..... B65D 65/00

(52) U.S. Cl. ..... 206/427; 62/457.5; 206/545; 229/103; 229/223

(58) Field of Search ..... 206/427, 541, 206/542, 545; 53/468, 491; 229/103, 101, 210, 223; 62/457.5, 457.7, 457.8, 457.9, 457.1; 493/63, 162

(56) References Cited

U.S. PATENT DOCUMENTS

| | | | | |
|---|---|---|---|---|
| 415,980 | A | | 11/1889 | Sachs |
| 975,792 | A | | 11/1910 | Pittman |
| 2,791,367 | A | | 5/1957 | Mefford |
| 2,810,506 | A | | 10/1957 | Kessler |
| 2,844,299 | A | | 7/1958 | Kessler et al. |
| 2,979,227 | A | | 4/1961 | Norton et al. |
| 3,006,165 | A | | 10/1961 | Mittelberger |
| 3,119,494 | A | | 1/1964 | Rosenstiel |
| 4,139,146 | A | | 2/1979 | Banburg et al. |
| 4,328,923 | A | | 5/1982 | Graser |
| 4,386,700 | A | | 6/1983 | Deaton |
| 4,676,429 | A | | 6/1987 | Crowe et al. |
| 4,687,130 | A | | 8/1987 | Beeler |
| 4,706,805 | A | | 11/1987 | Becher |
| 4,709,852 | A | | 12/1987 | Stoll |
| 4,777,992 | A | | 10/1988 | Olger |
| 4,858,444 | A | | 8/1989 | Scott |
| 4,869,387 | A | | 9/1989 | Persson |
| 4,899,553 | A | | 2/1990 | Drummond, III |
| 4,948,033 | A | | 8/1990 | Halsell, II et al. |
| 4,974,731 | A | | 12/1990 | Wood |
| 5,020,337 | A | | 6/1991 | Krieg |
| 5,072,876 | A | * | 12/1991 | Wilson ..... 206/427 |
| 5,094,359 | A | | 3/1992 | DeMars et al. |
| 5,101,642 | A | | 4/1992 | Alexandrov |
| 5,246,112 | A | * | 9/1993 | Stout et al. ..... 206/427 |
| 5,284,294 | A | | 2/1994 | Floyd |
| 5,303,863 | A | | 4/1994 | Arasim |
| 5,495,727 | A | | 3/1996 | Strong et al. |
| 5,582,343 | A | * | 12/1996 | Dalvey ..... 206/427 |
| 5,704,470 | A | * | 1/1998 | Sutherland ..... 206/427 |

* cited by examiner

*Primary Examiner*—Luan K. Bui
(74) *Attorney, Agent, or Firm*—Sheridan Ross P.C.

(57) ABSTRACT

A beverage cooler box is provided which is intended to receive ice or other cooling means to keep containers packaged therein cool. The box is made of a material which is impervious to liquid which may be contained within the box during use. The box includes folding end panels which extend continuously between adjacent front and rear panels; therefore, there are no seams or breaks in the material around the lower portion of the box which might degrade the ability of the box to hold a liquid. Also disclosed is a method of assembling the cooler box.

35 Claims, 4 Drawing Sheets

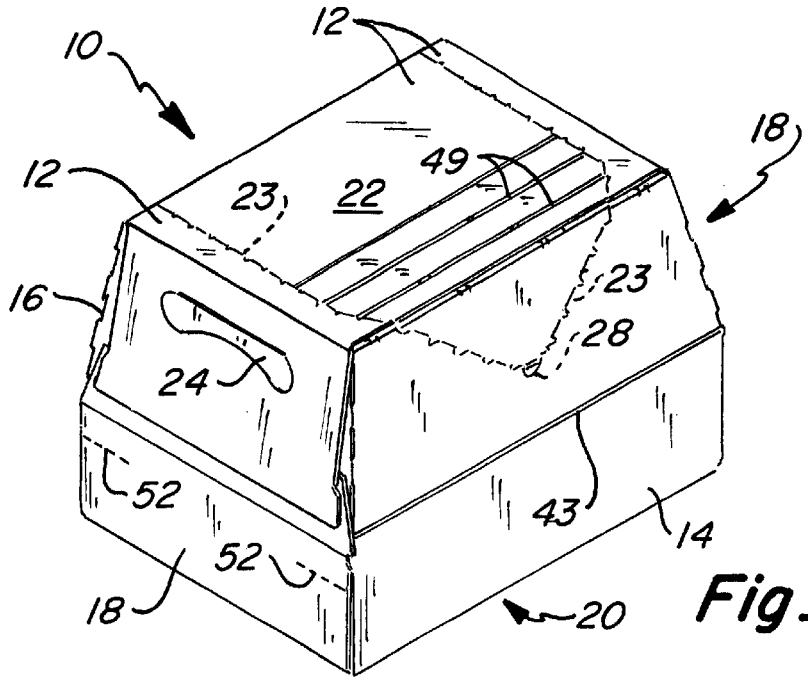
Fig_1
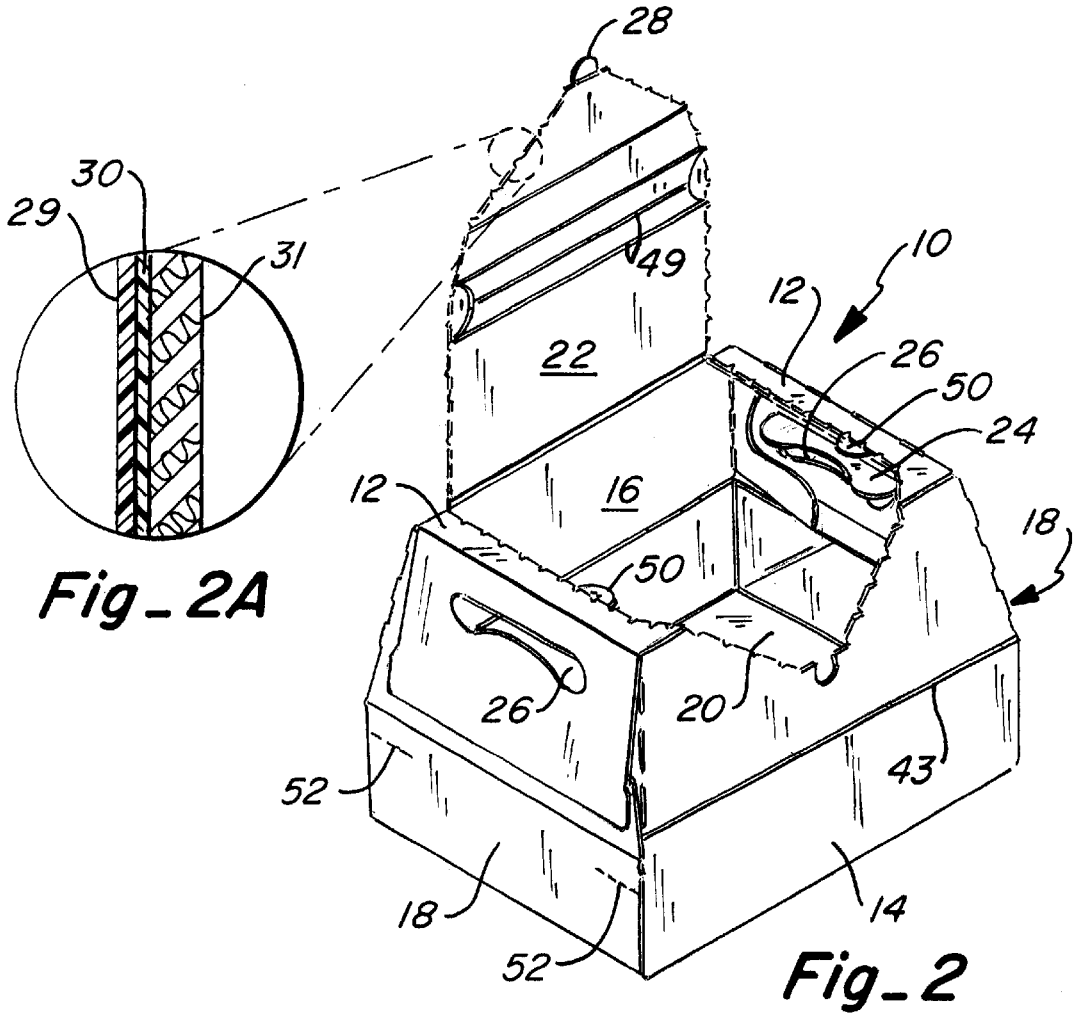
Fig_2A
Fig_2

BEVERAGE COOLER BOX

FIELD OF THE INVENTION

The present invention relates to packages for containers, and more particularly, to a package or box for a plurality of containers such as beverage or food containers, wherein the box is adapted for receiving ice or other cooling means to keep the containers chilled.

BACKGROUND OF THE INVENTION

Typically, beverages such as soda or beer are packaged in groups of six, twelve or twenty-four containers. If no refrigeration source is available, the beverages have to be consumed at the environmental temperature in which they are stored. The most common means for chilling such beverages is to place them in portable coolers, or to place them within refrigeration units.

A number of prior art devices exist which are intended to provide a package which is able to accept ice or other cooling means in order to chill containers in the package without having to use a separate cooling source. Thus, the containers can be chilled without having to use a refrigeration unit or a portable cooler.

One example of a reference disclosing a package expandable to accommodate ice include U.S. Pat. No. 5,495,727. This reference discloses a package which is expandable to accommodate ice to chill individual containers. The package includes drain holes which allow for drainage of any fluids which condense on the containers or which leak from the containers during shipment and handling. The package is lined with a waterproof or water resistant material to provide a means to prevent or substantially reduce leakage of liquids from within the package.

U.S. Pat. No. 4,329,923 discloses a cooler container for packaging a plurality of multiple articles such as cans or beverages. The container has a top portion designed to receive a quantity of bulk ice which may be placed in contact with the multiple articles. In operation, side and end flaps are pulled up and form an upper waterproof well area which retains the bulk ice. The well area is situated on top of the multiple articles which are packaged in a lower waterproof compartment.

U.S. Pat. No. 5,020,337 discloses a combination ice package and expandable cooler. This reference shows a box type receptacle with an extendable upper portion consisting of folded cardboard flaps. The upper portion further includes expandable top flaps which fold to form a top seal through the use of frictional engagement offset notches. Circular access layers are formed in the upper portion enabling drinks to be inserted and recooled while being consumed.

U.S. Pat. No. 5,094,359 discloses a combination packaging/shipping carton and ice bucket. This carton expands to be used as an ice bucket, in addition to its primary function of being a packaging carton for containers. The carton includes triangular webs which move from an abutting position to an inline position during forming of the carton to be used as the ice bucket. Side and end panels of the carton have foldable flaps which enclose the carton chamber to the environment. When the foldable flaps are moved away from each other to assume an inline position, the container is open to the environment, thus increasing the size of the container to permit usage of the carton as an ice bucket.

U.S. Pat. No. 5,303,863 discloses a beverage carton with an integral cooler bin. The carton includes a plurality of panels in a stacked relationship which, when unfolded, form an ice bin which is connectable to the top portion of the compartment of the carton. Ice is poured into the bin formed by the unfolded panels, and cans are cooled by direct contact with the ice.

While the foregoing inventions may be adequate for their intended purposes, each have certain disadvantages which are common to the prior art in general. One prominent disadvantage in many of the prior art inventions is that the cartons or packages are structurally complex, and are, therefore, expensive to manufacture. Additionally, although many prior art devices are structurally complex, they are not configured in a reinforced manner to hold ice or water for long periods of time. Another disadvantage of many of the prior art devices is that cooled water from melted ice is allowed to drain away from the package, which minimizes the cooling effect of melted ice. Each of these disadvantages are overcome with the box of this invention.

SUMMARY OF THE INVENTION

The beverage cooler box of the invention provides for packaging individual containers, and allows ice or other cooling means to be added directly to the box to cool or chill the containers. In its simplest form, the cooler box may be made from a single sheet of composite material which is cut to a desired shape, and then folded along fold lines and score lines to an assembled shape. The cooler box is a six-sided structure having spaced and substantially parallel lower and upper panels, spaced front and rear panels, and spaced and substantially parallel end panels which abut the front and rear panels in perpendicular arrangement. The front, rear and end panels are gabled or slightly sloped. When assembled, the cooler box defines an open interior space which may hold various types of containers or objects that are to be marketed to a consumer. Perforations on the end panels define flaps which may be pushed inwardly, and the resulting holes or gaps can be used as handle openings. Perforations on the upper portion of the front panel and continued perforations on the upper panel define the lid of the box. After these perforations are broken, the lid may be opened. The lid may be reattached and secured to the cooler box by a pair of protruding tabs formed on the upper panel. A liquid containment area is defined within the cooler box by lower portions of the end panels, front and rear panels, and the lower panel.

The end panels incorporate a unique folding combination of flaps which provide considerable strength to the construction of the box, and ensure the integrity of the liquid containment area. Each end panel has a major lower flap connected along an edge of the lower panel. A pair of opposing minor lower flaps extend from lower portions of the front and rear panels. The major lower flap is positioned between and connected to the minor lower flaps. The minor lower flaps are folded back upon themselves when the free end of the major lower flap is lifted upwards. The upper portions of the end panels include a pair of opposing minor upper flaps. A major upper flap is also provided and connected along an edge of the upper panel. The major upper flap is positioned between the minor upper flaps. Each lower minor flap is connected to a corresponding minor upper flap by a web. A gap exists between the web and an adjacent corner of the cooler box. The minor upper flaps are folded inward simultaneously with the lower minor flaps because of the webs which interconnect the minor lower flaps to their corresponding minor upper flaps. The gaps allow the minor upper flaps to deflect downward, which enables both the minor upper and minor lower flaps to fold without interference. The end panels may be secured by an adhesive applied to the major upper flap which is placed over and in contact with the major lower flap.

The cooler box is constructed of a material which has not only advantageous strength characteristics, but is also substantially water-resistant to allow melted ice or other cooling liquid to remain within the box, and thus able to continue to cool containers within the box. Of course, if the liquid is desired to be removed, it may be simply poured out from the opened lid. Preferably, the box is constructed of a multiple-layered material, including a kraft board substrate, and a polyethylene film or membrane which is applied to the substrate by a heated polyethylene extrudate. The extrudate may be applied upon the substrate, and then the polyethylene film may be applied to the substrate wherein the extrudate bonds the substrate to the polyethylene film. The extrudate is molten when applied and may be extruded through a die which results in formation of a liquid curtain of extrudate applied to the substrate. When the box is assembled, the polyethylene film is on the outside or exposed surfaces of the box. Accordingly, liquid contained within the box is able to seep into the substrate, but is prevented from leaking from the box by both the extrudate and the polyethylene film. Therefore, there are essentially two layers of water-impervious materials which are used to prevent liquid from escaping the interior of the box. Conveniently, the polyethylene film is also an ideal material which may accept printing or labeling. Printed material may be directly applied to the polyethylene film. The film can accept printing by reverse or surface printing methods.

BRIEF DESCRIPTION OF THE DRAWINGS

FIG. 1 is a perspective view of the beverage cooler box of this invention;

FIG. 2 is another perspective view of the cooler box of this invention showing the lid opened and the handle flaps punched in;

FIG. 2A is a greatly enlarged cross section of the designated area on FIG. 2 showing the composite or multilayered material which may be used;

DETAILED DESCRIPTION OF THE DRAWINGS

Figure 3:
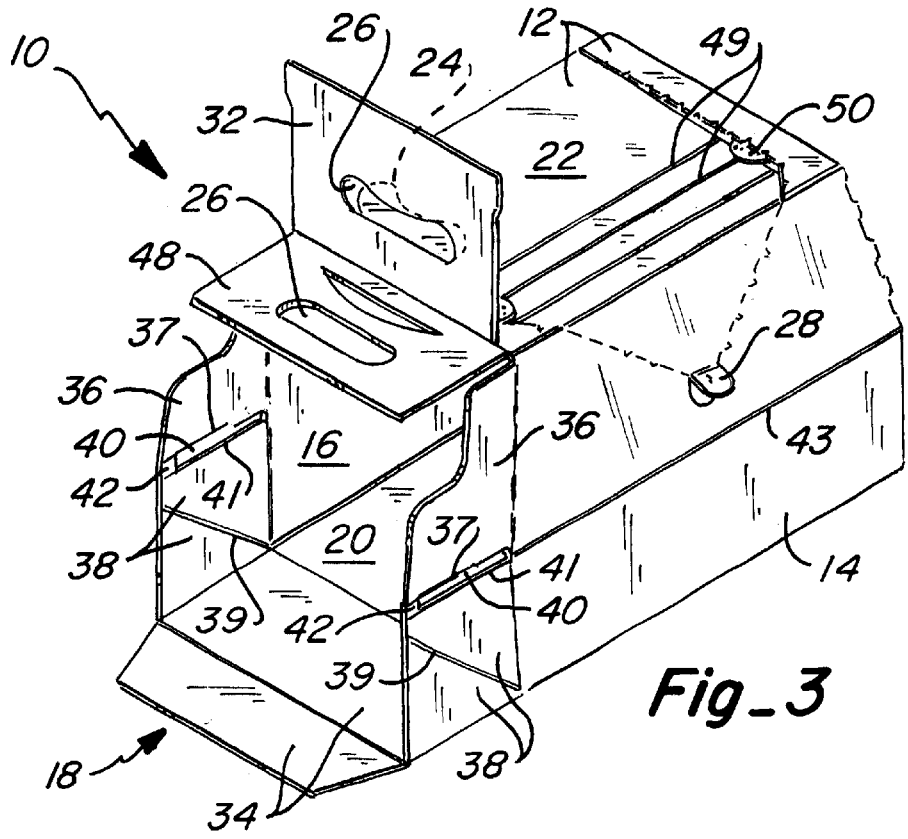
FIG. 3 is another perspective view of the cooler box of this invention partially assembled, namely, one end panel of the box is open showing the various components which form an end panel.

FIGS. 1 and 2 are perspective views of the box 10 according to a preferred embodiment of the present invention. In the perspective view of FIG. 1, the box 10 is assembled, and has yet to be opened by a consumer. The box is defined by a plurality of panels including an upper panel 12, front panel 14, rear panel 16, end or side panels 18, and lower panel 20. The lid 22 is defined by perforations 23 formed on the upper portion of front panel 14, and perforations 23 which extend rearwardly on opposing sides of the upper panel 12. A thumb perforation 28 is provided to allow a consumer's thumb to be inserted. Then, the consumer simply pulls back along the perforations 23 to create the lid 22. The box 10 may be transported by handle openings formed on the end panels. Specifically, handle perforations 25 (see FIG. 6) define handle openings 26 which are created when handle flaps 24 are pushed inwardly to break the perforations.

FIG. 2 illustrates the lid opened, and also illustrates handle openings 26. Tabs 50 are formed on the upper panel 12. If it is desired to reclose the lid 22, the portions of the lid 22 adjacent the tabs 50 are simply placed underneath the tabs 50 in order to keep the lid closed as shown in FIGS. 3 and 4.

FIG. 2A illustrates the composite or multilayered structure of the material which may be used for the box of this invention. The cross section shown is not necessarily to scale, and is simply provided to show the multilayered nature of the material. Specifically, the polyethylene film 29 is shown as the exterior layer, which is secured to the substrate 31 by the thin layer 30 of polyethylene extrudate.

Figure 4:
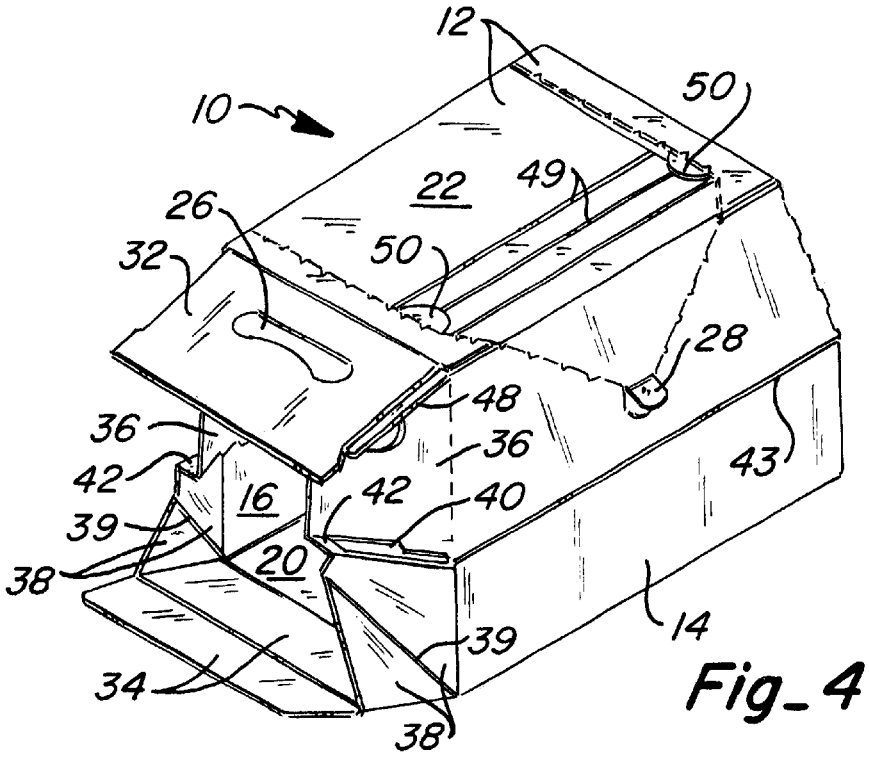
FIG. 4 is another perspective view of the cooler box illustrating the opened end panel being partially closed illustrating the manner in which the various components of the end panels fold and fit together to form an assembled end panel.

FIGS. 3 and 4 illustrate one end panel opened in order to demonstrate the manner in which the various flaps are folded to form an end panel. As shown in these figures, each end or side panel 18 includes a plurality of flaps, namely, a major upper flap 32, a major lower flap 34, a pair of opposing minor upper flaps 36, and a pair of opposing minor lower flaps 38.

Figure 6:
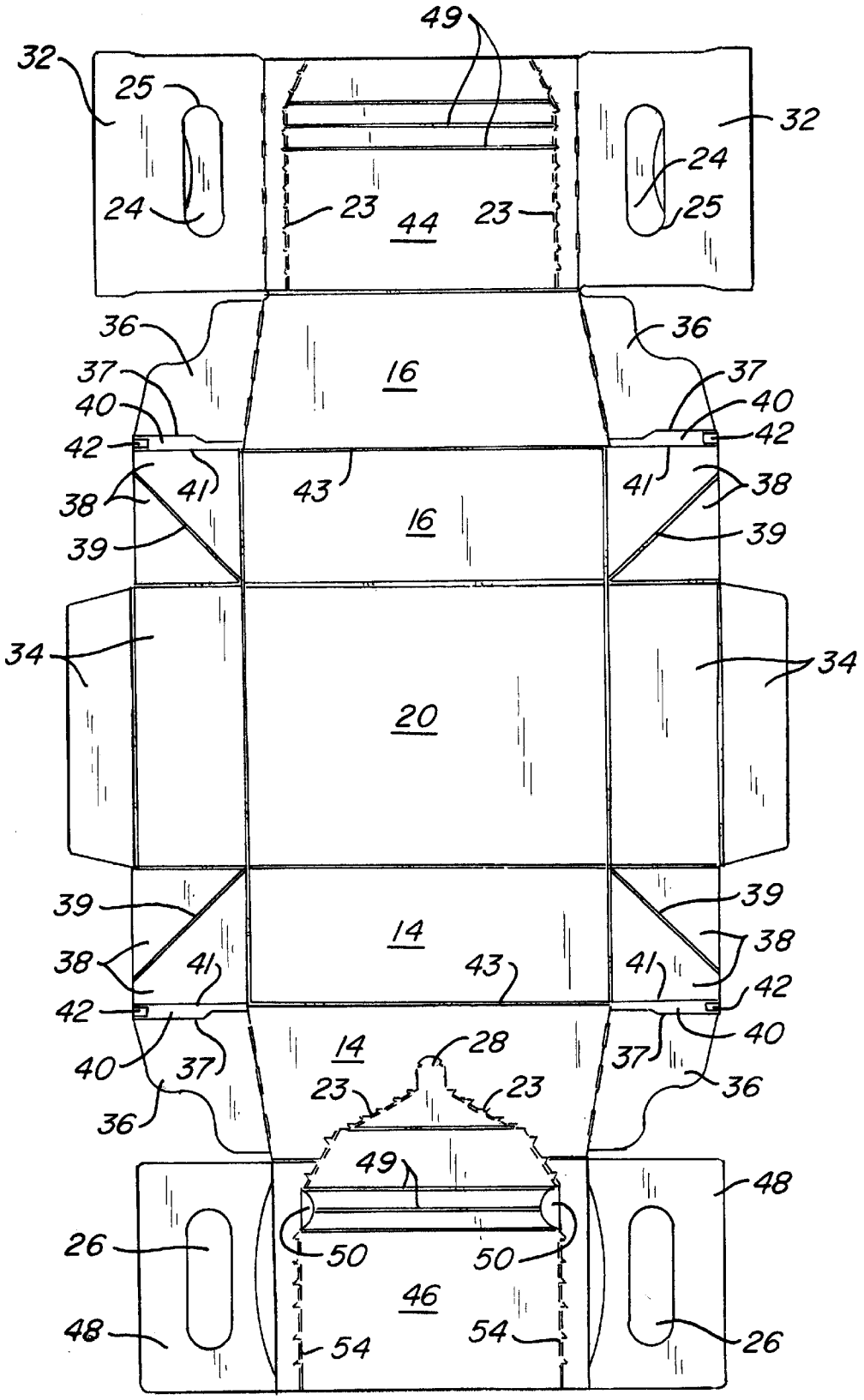
FIG. 6 is a plan view of the cooler box prior to assembly, illustrating the various fold lines and score lines, as well as other details of the invention.

Referring briefly to FIG. 6, a diagonal fold or score 39 is provided dissecting each minor lower flap 38 into two triangular sections. Referring back to FIGS. 3 and 4, when major lower flap 34 is lifted, the opposing pair of minor lower flaps 38 are folded back upon themselves along score lines 39. As the major lower flap 34 is further lifted, the minor upper flaps 36 are also moved to a closed position. Web 42 interconnects corresponding minor upper and minor lower flaps which are attached along the same panel (front or rear). A slot or gap 40 is formed between the lower edge 37 of the minor upper flap 36, and the upper edge 41 of minor lower flap 38. When the minor upper flaps 36 are rotated to the closed position, the free end of the flaps move slightly downward because horizontal fold lines 43 on the front and rear panels tend to allow the front and rear panels to collapse outwardly along these fold lines 43. Thus, the upper portions of the front and rear panels above fold line 43 slope upwardly toward the upper panel 12, and the lower portions of the front and rear panels below fold line 43 slope in a reverse fashion toward the lower panel 20. Gaps 40 and webs 42 accommodate the downward displacement of the minor upper flaps 36 to ensure they do not contact the upper edges 41 of the minor lower flaps 38. The webs 42 deflect outward at their connections with the minor upper flaps 36 as the minor upper and minor lower flaps are rotated closed. To fully close the lower portion of an end panel 18, the major lower flap 34 is lifted to a vertical orientation and placed flush against the folded minor flaps. The major upper flap 32 is then folded over the major lower flap 34. Alternatively, the major upper flap 32 may be folded and placed flush against the folded minor flaps, and then the major lower flap 34 may be secured against the major upper flap 32. An adhesive may be applied to the interior surface of the most exterior major flap which contacts the other flap in order to secure the end panel shut. FIGS. 3 and 4 also show fold lines 49 on the lid 22. These fold lines give some flexibility to the lid 22, so that the lid may be more easily manipulated. An overflow line 52 (FIGS. 1 and 2) may be indicated on the box which delineates a recommended maximum fill line for liquid within the box. This fill line is placed below the upper edges of the minor lower flaps 38 and major lower flaps 34. Otherwise, liquid would be able to flow over these upper edges.

Figure 5:
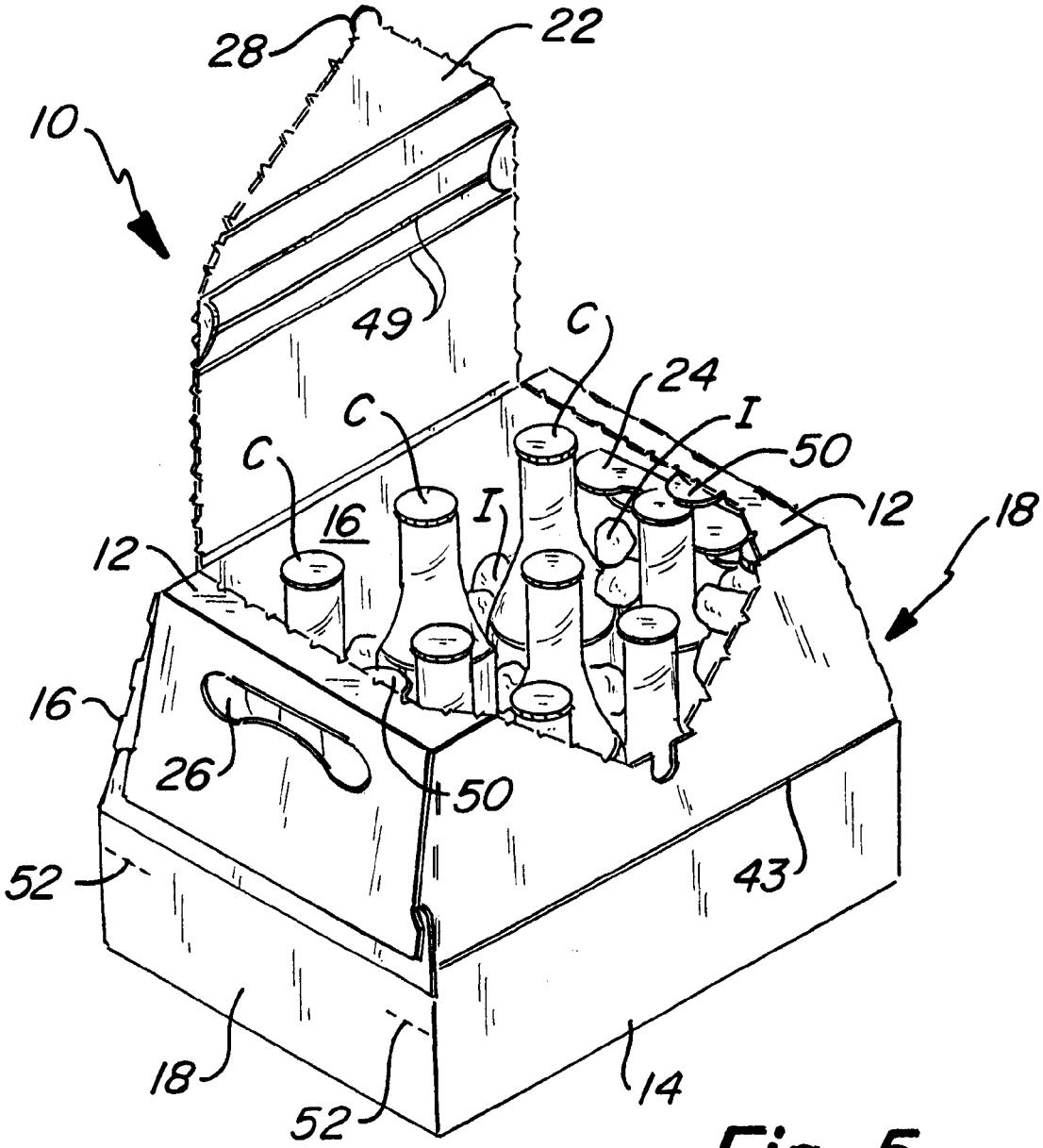
FIG. 5 is another perspective view similar to FIG. 2, but showing the box containing a plurality of containers and ice.

FIG. 5 simply illustrates containers C in the box along with a cooling means in the form of ice I. Although bottles are shown as the containers, it shall be understood that cans or other types of containers may be used with the box of this invention. Additionally, other cooling means could be used including a frozen slush mixture of water and ice, or conventional ice packs which are of the type that are refrozen.

FIG. 6 illustrates the box of this invention prior to being folded. The upper panel 12 includes both an exterior panel flat 44, and an interior panel flat 46. Additionally, interior end panel flaps 48 are provided which extend from opposite sides of interior panel flat 46. When the box is assembled, interior panel flat 46 is placed under exterior panel flat 44. An adhesive may then be used to attach exterior panel flat 44 to interior panel flat 46. Lid perforations 54 are also provided on interior panel flat 46 which align and match the lid perforations 23 on the exterior panel flat 44. Therefore, the upper panel 12 is a double reinforced member. For the interior end panel flaps 48, they simply comprise rectangular members with elliptical openings formed therethrough corresponding to the handle openings 26. Interior end panel flaps 48 are aligned under and are attached to their corresponding major upper flaps 32. Thus, the major upper flaps 32 are also of double reinforced construction. FIG. 3 shows one interior end panel flap 48 separated from its major upper flap 32 for purposes of illustrating how the members overlie when the box is assembled. Referring back to FIG. 6, tabs 50 are simply formed by creating half-moon shaped perforations or cuts along upper interior panel flat 46. FIG. 6 also shows the strategic placement and location of various score lines and fold lines which allow the box to be folded to its operational or final shape. Because of the thickness of the substrate, simply providing fold lines at some locations may make it too difficult to effectively form the shape of the box during assembly. Thus, score lines which are simply partial cuts in the substrate allow the material to be more easily folded. One location where score lines are preferable is at score lines 39 which enable the minor lower flaps 38 to be folded back upon themselves. The score lines may actually include closely spaced parallel score lines. These score lines only penetrate the substrate, and do not compromise the integrity of the polyethylene film or the extrudate.

In addition to the box described above, the invention herein also includes a method of assembling a beverage cooler box including a liquid containment area which may hold melted ice or other cooling means to cool containers within the box. The method comprises the steps of providing a precut piece of material, providing various fold and/or score lines on the precut material, and folding the material into a final shape based upon the various fold/score lines, wherein the material includes continuous minor lower end flaps interconnecting the front and rear panels, and which are folded to maintain continuity of the polyethylene film. Without the minor lower flaps, there would be no continuous piece or section of material which joined the lower portions of the end panels to the lower portions of the front and rear panels. These minor lower flaps provide a continuous seal, even across score lines 39. Simply attaching the end panels to the front and rear panels by a free-hanging flap attached to either the end panels or the front and rear panels would make it much more difficult to maintain the sealed integrity of the liquid containment area. Adhesive or some other bonding agent alone would be inadequate to maintain a seal at the corners between the end panels and the front and rear panels.

By the foregoing, it can be seen that the box of this invention has many advantages. The box may be made of a single piece of material which is cut into a desired shape, and includes various fold and score lines delineating the various folds and bends of the box when assembled. The dual layer of water-impermeable components allows the box to receive and hold ice or other cooling means. This dual layer is not compromised when the box is assembled. Therefore, after assembly, no additional steps are necessary in maintaining the waterproof nature of the box. The unique construction of the end panels provides not only strength, but also maintains the integrity of the liquid containment area. The closing tabs enable a user to close the lid to prevent undesirable heat exchange with the environment when ice or other cooling means is added to the container. The box is of simple construction, yet effectively serves the dual purpose of providing packaging for containers, and providing a package which allows the containers to be cooled directly within the package.

This invention has been described with respect to a preferred embodiment; however, it will be understood that various modifications and changes can be made which are contemplated within the spirit and scope of this invention.

What is claimed is:

1. A beverage cooler box comprising:

a plurality of panels including opposing front and rear panels, opposing upper and lower panels, and opposing end panels, said plurality of panels when assembled forming a container enclosing an interior space, said front and rear panels having respective upper and lower portions; and said end panels each including a foldable upper flap and a foldable lower flap, said foldable lower flap not attached to said foldable upper flap each said foldable lower flap including a major lower flap attached along an edge of said lower panel and a pair of opposing minor lower flaps continuously interconnecting the major lower flap and the lower portions of said front and rear panels thereby defining a liquid containment area.

2. A box, as claimed in claim 1, wherein:

said upper panel includes at least a pair of perforations defining a lid, said lid being activated by lifting a portion of the upper panel between said perforations to break the perforations.

3. A box, as claimed in claim 1, further including:

closing tabs formed on said upper panel.

4. A box, as claimed in claim 1, wherein:

said end panels further include handle openings formed therethrough.

5. A box, as claimed in claim 1, wherein:

said foldable upper flap includes a major upper flap attached along an edge of said upper panel and a pair of opposing minor upper flaps attached along edges of said front and rear panels.

6. A box, as claimed in claim 1, wherein:

said minor lower flaps each include a diagonal line enabling them to be folded back upon themselves.

7. A box, as claimed in claim 1, wherein:

said plurality of panels include designated score lines and fold lines defining areas on the box which are folded when the box is assembled to achieve a final box shape.

8. A box, as claimed in claim 5, wherein:

adjacent minor upper and minor lower flaps include a gap situated therebetween.

9. A box, as claim in claim 5, further including:

a web interconnecting corresponding upper minor and lower minor flaps.

10. A box, as claimed in claim 5, wherein:

said major lower flap is connected between said pair of opposing minor lower flaps, and said major lower flap is foldable upward which also simultaneously folds said pair of opposing minor lower panels back upon themselves.

11. A box, as claimed in claim 1, wherein:

said box includes a liquid level line defining a recommended maximum fill line for liquid within said box.

12. A box, as claimed in claim 1, wherein:

said upper panel includes an exterior panel flap, and an interior panel flap secured to said exterior panel flap.

13. A box, as claimed in claim 1, wherein:

said plurality of panels are made from a single sheet of precut material.

14. A box, as claimed in claim 1, wherein:

said box is made of a composite material including a substrate and a polyethylene film bonded to said substrate.

15. A box, as claimed in claim 14, wherein:

said polyethylene film is bonded to said substrate by a polyethylene extrudate.

16. A method of assembling a beverage cooler box comprising the steps of:

providing precut material including a plurality of score lines and fold lines; securing opposite ends of the material and connecting said opposite ends to form an upper panel of the box;

folding the material along designated fold lines to define front, rear, and lower panels of the box;

further folding the material along other designated fold lines and score lines to form a pair of opposing end panels, each said end panel including a plurality of flaps defining a continuous and unbroken interconnection of material between the front and rear panels;

further folding the material along the continuous and unbroken interconnection of material thereby closing the end panels against the cooler box and maintaining an unbroken seal defining a liquid containment area; and forming perforations on the upper panel, said perforations forming a lid.

17. A method, as claimed in claim 16, further including the steps of:

constructing the material from at least two layers, said two layers including a substrate and a water-impermeable membrane.

18. A method, as claimed in claim 16, wherein:

said material includes a substrate and a polyethylene film bonded to said substrate.

19. A method, as claimed in claim 18, wherein:

said polyethylene film is bonded to said substrate by a polyethylene extrudate.

20. A beverage cooler box comprising:

a plurality of panels including opposing front and rear panels, opposing upper and lower panels, and opposing end panels, said plurality of panels when assembled forming a container enclosing an interior space;

means for sealing said cooler box, said means for sealing enabling liquid to be contained within said interior space;

perforations formed on said upper panel defining a lid; and wherein said lower panel, lower portions of said front and rear panels and said end panels define a liquid containment area extending continuously and unbroken around said cooler box, said end panels including a plurality of foldable flaps continuously interconnecting said end panels to said front and rear panels.

21. A beverage cooler box, as claimed in claim 20, wherein:

said means for sealing includes a polyethylene film.

22. A beverage cooler box, as claimed in claim 20, wherein:

said means for sealing includes a polyethylene film and a coating of polyethylene extrudate.

23. A beverage cooler box, as claimed in claim 20, wherein:

said means for sealing includes a water impermeable membrane.

24. A box, as claimed in claim 20, further comprising:

a handle opening form through each said end panel.

25. A box, as claimed in claim 20, wherein:

said foldable flaps of said end panels each include a foldable upper flap and a foldable lower flap.

26. A box, as claimed in claim 25, wherein:

said foldable upper flap includes a major upper flap attached along an edge of said upper panel and a pair of opposing minor upper flaps attached along edges of said front and rear panels.

27. A box, as claimed in claim 26, wherein:

adjacent minor upper and minor lower flaps include a gap situated therebetween.

28. A box, as claimed in claim 26, further including:

a web interconnecting corresponding upper minor and lower minor flaps.

29. A beverage cooler box comprising:

a plurality of panels including opposing front and rear panels, opposing upper and lower panels, and opposing end panels, said plurality of panels when assembled forming a container enclosing an interior space, said front and rear panels having respective upper and lower portions;

wherein said end panels each include a foldable upper flap and a foldable lower flap, said lower foldable flaps of each said end panel along with said lower portions of said front and rear panels and said lower panel defining a liquid containment area; and said foldable upper flap includes a major upper flap attached along an edge of said upper panel and a pair of opposing minor upper flaps attached along edges of said front and rear panels, and wherein said foldable lower flap includes a major lower flap attached along an edge of said lower panel and a pair of opposing minor lower flaps located below said minor upper flaps, and attached to said front and rear panels.

30. A box, as claimed in claim 29, wherein:

said minor lower flaps each include a diagonal line enabling them to be folded back upon themselves.

31. A box, as claimed in claim 29, wherein:

adjacent minor upper and minor lower flaps include a gap situated therebetween.

32. A box, as claimed in claim 29, further including:

a web interconnecting corresponding upper minor and lower minor flaps.

33. A box, as claimed in claim 29, wherein:

said major lower flap is connected between said pair of opposing minor lower flaps, and said major lower flap is foldable upward which also simultaneously folds said pair of opposing minor lower panels back upon themselves.

34. A beverage cooler box comprising:

a plurality of panels including opposing front and rear panels, opposing upper and lower panels, and opposing end panels, said end panels each including a foldable upper flap and a foldable lower flap, said lower foldable flaps of each said end panel along with lower portions of said front and rear panels forming a continuous and unbroken interconnection of material defining a liquid containment area; and a plurality of perforations formed on said upper panel, said perforations defining a lid wherein when the perforations are broken and the lid is opened, contents of the beverage cooler box are exposed.

35. A method of assembling a beverage cooler box comprising the steps of:

providing a piece of precut material including a plurality of designated lines;

folding the material along the designated lines to define front and rear panels, upper and lower panels, and a pair of opposing end panels, each said end panel including a plurality of flaps defining a continuous and unbroken interconnection of material between the front and rear panels;

further folding the material along the continuous end unbroken interconnection of material thereby closing the end panels against the cooler box, the unbroken interconnection of material and lower portions of said front and rear panels defining a liquid containment area; and forming perforations on the upper panel, said perforations defining a lid.

* * * * *

UNITED STATES PATENT AND TRADEMARK OFFICE

CERTIFICATE OF CORRECTION

PATENT NO. : 6,631,803 B2 
DATED : October 14, 2003
INVENTOR(S) : Rhodes et al.

It is certified that error appears in the above-identified patent and that said Letters Patent is hereby corrected as shown below:

Column 6,
Line 38, after "foldable upper flap" insert -- , -- therein.

Signed and Sealed this

Ninth Day of December, 2003

JAMES E. ROGAN
*Director of the United States Patent and Trademark Office*